United States Patent [19]

Palmer

[11] 3,943,586

[45] Mar. 16, 1976

[54] DORY

[76] Inventor: John D. Palmer, 7702 Speedway, Everett, Wash. 98203

[22] Filed: Dec. 23, 1974

[21] Appl. No.: 535,182

[52] U.S. Cl. ..... 9/6 M; 114/63; 114/179

[51] Int. Cl.[2] ..... B63B 3/09

[58] Field of Search ..... 9/6, 1 R, 6.5, 6 M; 114/56, 63, 179–181

[56] References Cited

UNITED STATES PATENTS

| | | | |
|---|---|---|---|
| 1,625,598 | 4/1927 | Friet et al. | 9/6 |
| 1,718,764 | 6/1929 | Sochurek | 9/6 |
| 1,848,502 | 3/1932 | Seaman | 114/56 |
| 2,370,508 | 2/1945 | Wilkie | 114/179 |
| 2,724,132 | 11/1955 | Shoup et al. | 9/6 |
| 2,741,207 | 4/1956 | Leone | 114/56 |
| 3,064,283 | 11/1962 | Swanson | 9/6 |
| 3,371,362 | 3/1968 | Butler | 9/6 |

*Primary Examiner*—Trygve M. Blix
*Assistant Examiner*—Stuart M. Goldstein
*Attorney, Agent, or Firm*—Seed, Berry, Vernon & Baynham

[57] ABSTRACT

A square-sterned dory of welded aluminum construction in which the chines diverge for their full length and an engine well is located forward of the transom and is open through the transom as well as through the bottom. Box cross-braces serve as seats and storage compartments, and bracing is added by a forward deck or seat and skirt providing a front compartment. A hawsepipe is provided at the bow which extends through the forward compartment to the forward end of the bottom for convenience in handling an anchor when the dory is used as a river drifter.

7 Claims, 8 Drawing Figures

FIG. 1
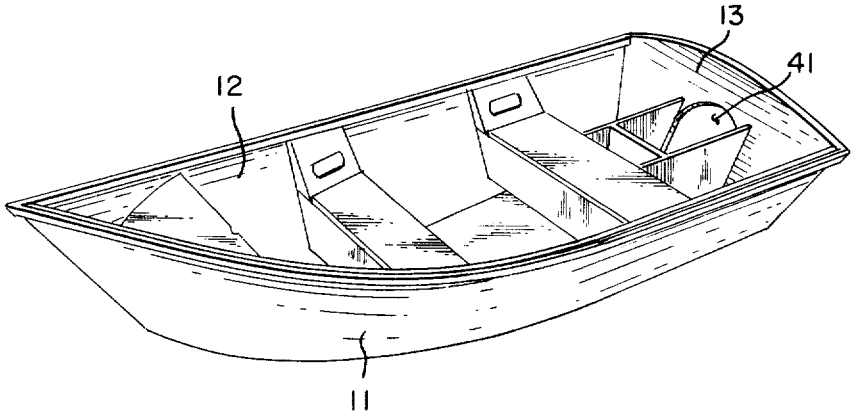
FIG. 2
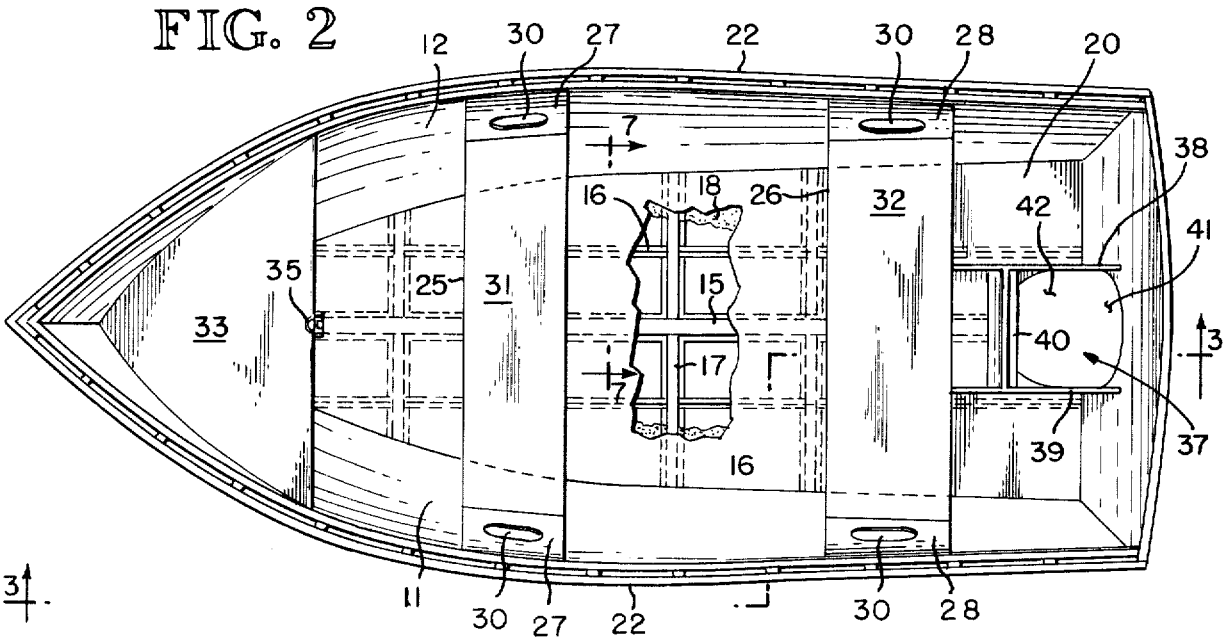
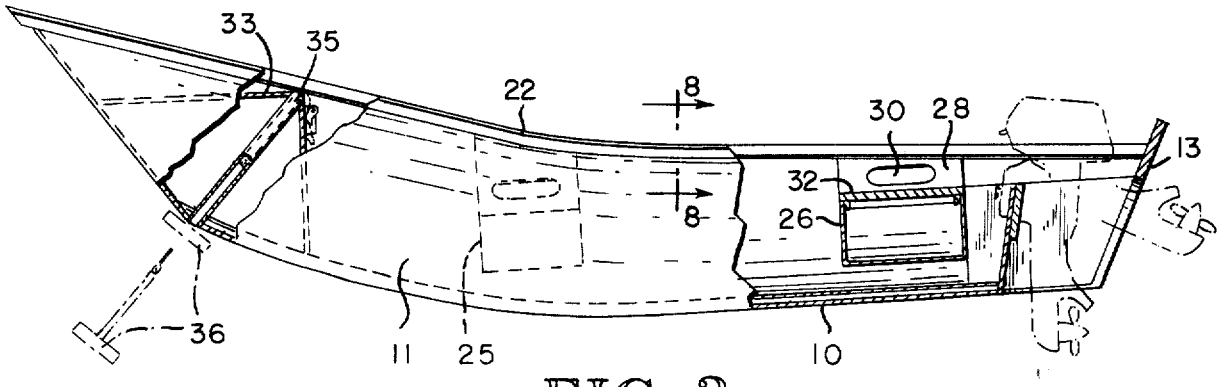
FIG. 3

FIG. 4
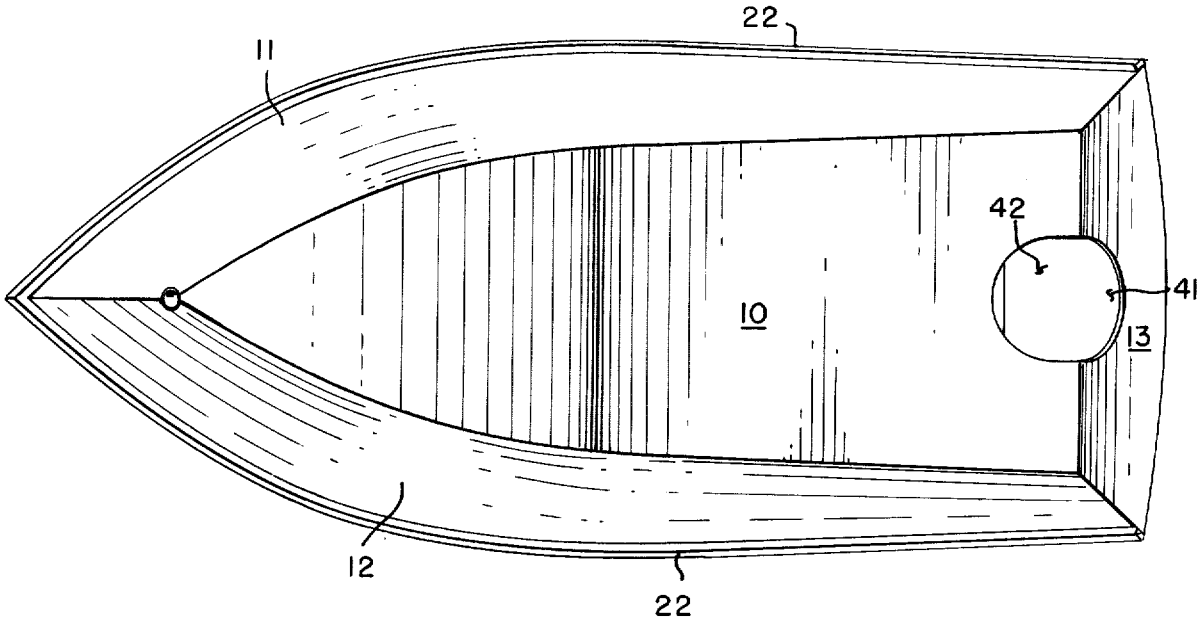
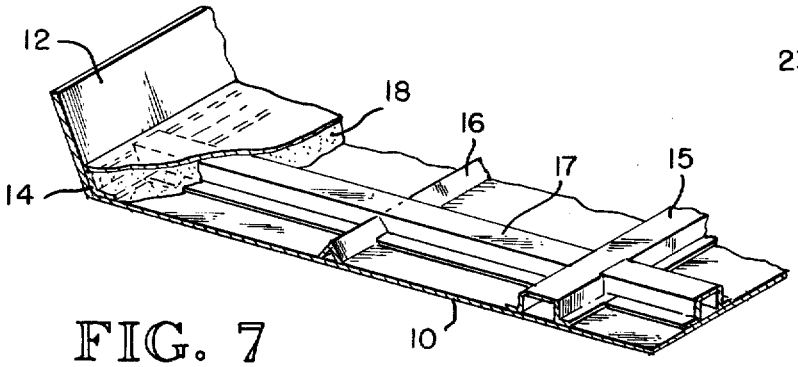
FIG. 7
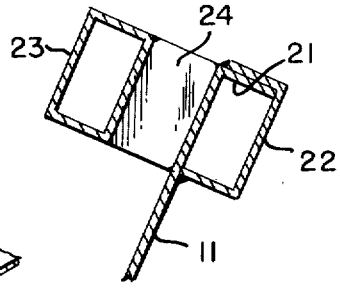
FIG. 8
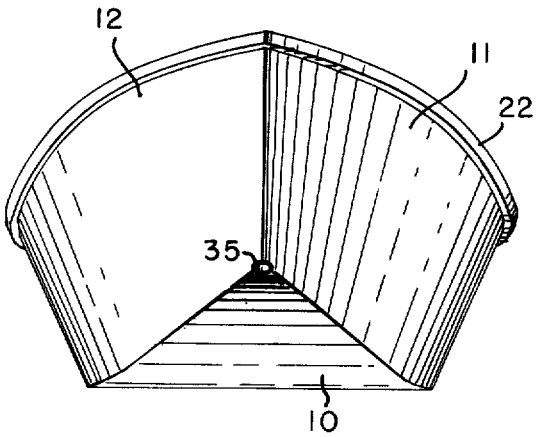
FIG. 5
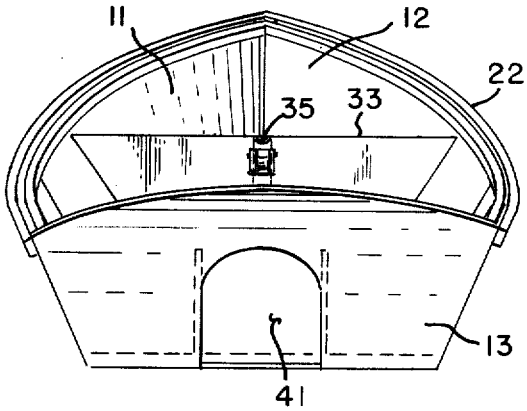
FIG. 6

DORY

FIELD OF THE INVENTION

This invention relates to an improved square-sterned dory of the type having a motor well forward of the transom and which is particularly adapted to welded aluminum construction.

OBJECTS

The invention aims to provide a dory especially suitable for use as a river drift boat and which can be easily rowed as well as power operated.

A further object is to provide a dory with superior handling characteristics and which is unusually safe in operation.

Still another object is to provide a dory of welded aluminum construction which is particularly durable and yet practical to build.

Other objects and advantages will appear during the course of the following description.

BRIEF DESCRIPTION OF THE FIGURES OF THE DRAWING

FIG. 1 is a perspective view of a dory in accordance with the present invention;

FIG. 2 is a plan view of the dory with part of the floorboard broken away;

FIG. 3 is a side elevational view of the dory partly in vertical section;

FIG. 4 is a bottom plan view of the dory;

FIG. 5 is a front elevational view of the dory;

FIG. 6 is a rear elevational view of the dory;

FIG. 7 is a detailed perspective view of part of the bottom construction of the dory taken as indicated by line 7—7 of FIG. 2; and FIG. 8 is a detailed transverse sectional view taken along the line 8—8 of FIG. 3.

DETAILED DESCRIPTION OF THE PREFERRED EMBODIMENT

Referring to the drawings, the preferred embodiment of the boat of the present invention is of welded aluminum construction with the bottom 10, sides 11–12 and flat transom 13 each being formed from a single sheet. The transom has side terminal flanges lapping the sides 11–12 and welded thereto, and the sides 11–12 are welded together and to respective chines 14 of angle section. Between the chines, the bottom 10 is reinforced by a grid comprising a keelson 15, a pair of stringers 16, and a plurality of ribs 17 welded to the bottom and to one another at their intersections.

From FIG. 7 it will be noted that the keelson 15 and ribs 17 have a hat section and the stringers 16 have an angle section, and that at the intersection of the ribs 17 with the stringers 16, the side flanges of the ribs are cut out to fit over the stringers so that the stringers are intact for their full length. It will also be seen that the ribs 17 do not extend the full width of the bottom but only between the side flanges of the keelson 15 and the chines 14. The spaces between the bottom reinforcing members may be filled with flotation material, such as polyethylene foam sheets 18, and covered by marine plywood floorboards 20.

At their upper edge, the sides 11–12 have an outwardly turned flange 21 which interfits with a channel 22 to form a gunwale welded in position. This gunwale is complemented by an inwale 23 of box section spaced from the sides 11–12 by suitable blocks 24 welded in place. Oarlocks are suitably located midlength of the gunwale.

Cross-bracing of the sides 11–12 is accomplished by aluminum box ribs 25, 26 of a channel section welded in position, spaced above the bottom 10 and having upper gussets 27 and 28, respectively, at their ends. Each of these gussets has triangular front and back walls joined by a bottom wall and a sloped center wall having an oblong opening 30 for storage access. The box ribs 25, 26 serve as storage compartments and have removable wood covers 31, 32 functioning as seats as well as providing easy access to the boxes for stowage of fish, ice, food, clothing and gear. Further cross-bracing is accomplished by an aluminum deck or seat 33 welded to the sides at the bow and a skirt continuing from the seat and welded to the sides and bottom. Functionally, the skirt may be considered as a forward cross-rib.

As shown in FIG. 3, an open-ended hawsepipe 35 slopes forwardly from the aft edge of the deck to the lower end of the stem to open at the apex of the bottom 10. An anchor line is fed through the hawsepipe to an anchor 36 having a disc head and a rod stem adapted to fit into the hawsepipe. The anchor line may be secured by a conveniently located jamb cleat (not shown). This anchor arrangement is particularly useful when the boat is being used as a drifter on a river for fishing, as for steelhead, for example. The skirt may have a center access opening to the bow compartment beneath the deck 33 for stowage of the anchor line or other gear.

A novel feature of the boat is the providing of a boat well 37 at the stern to receive an outboard motor. This well is defined on the sides by a pair of opposed side plates 38, 39 welded to the transom, the bottom 10 and the back of the rear box rib 26, and is defined at the front by a sloped cross-plate 40 welded to the bottom 10 and the side plates. At the stern, the well opens aft through an opening 41 (see FIG. 6) in the transom which merges with an opening 42 cut in the bottom 10. The cross-plate 40 is preferably faced with wood mounting plates for proper thickness to receive the mounting yoke of an outboard motor. As indicated in phantom in FIG. 3, the cutout 41 in the transom permits an outboard motor to be tilted upwardly far enough to clear the bottom and provides easy access to the propeller in case it is fouled or a shear pin needs to be replaced. In view of the stern cutout 41, the transom 13 is preferably arched upwardly along its upper edge.

Directing attention to the shape of the bottom 10, it should be noted that the side edges (chines) diverge for their full length, including the length of a flat aft portion which, as best seen in FIG. 3, extends forwardly from the transom 13 slightly more than 40 percent of the length of the bottom to a point adjacent the rear of the forward seat 31. The bottom 10 then curves upwardly in the forward direction through the rest of its length. As illustrated in FIG. 2, the sides 11–12 slope outwardly from the bottom 10 for their full length, and the flat transom 13 is also sloped. Referring to FIGS. 2 and 3, it will be noted that the aft portion of the gunwale is straight and diverges from the transom forwardly for substantially the full length of the flat aft portion of the bottom 10, and then its shear line curves upwardly and converges to the prow.

One of the novel features of the invention is the above-described arrangement wherein the aft portions of the chines diverge toward the transom while the correspoonding portions of the gunwales converge toward the transom. This arrangement, and particularly the aft diverging of the chines, gives superior steering and headway characteristics.

A typical dory constructed in accordance with the present invention may be about 16 feet in length along the gunwale and have a beam of nearly 7 feet. Such a boat has a freeboard varying from about 27 to 32 inches and, when constructed with 0.080 inch aluminum plate and 0.180 inch aluminum structurals, weighs about 325 pounds when empty. With a conventional outboard engine of from 18 to 40 h.p., the dory has outstanding planing performance. It can be rowed at 3 to 5 knots.

The dory of this invention is also designed for sailing. A center board well may be provided through the center of the front box 25 and a mast step provided behind the deck 33. The engine well 37 is adapted to receive a rudder mounted on the cross-plate 40. When fitted with a lug mainsail and genoa jib, the dory sails stiff and high pointing with excellent speed.

Although the improved dory has been described as fabricated from aluminum, it is to be understood that other materials or combinations of materials could be used, as, for example, glass-fiber reinforced plastic.

The embodiments of the invention in which a particular property or privelege is claimed are defined as follows:

1. A dory comprising:

a bottom panel having a stern edge, a bow end, and symmetrical side edges diverging aft for their full length from said bow end to the ends of said stern edge, said bottom panel having a flat stern portion extending from said stern edge forwardly approximately half the length of the dory and having a generally trapezoidal shape defined on three sides by said stern edge and rear portions of said diverging side edges, and said bottom panel having a curved forward position curving upwardly uniformly across its width from the fourth side of said stern portion forwardly between said side edges to said bow end, a transom sloping aft from a connection with said stern edge and having opposed upwardly diverging end edges, opposed outwardly sloping side panels connected to said end edges of the transom and side edges of the bottom and connected together at the bow to form a forwardly sloping stem, respective gunwales along the upper edges of said side panels, said gunwales diverging from said stem outwardly of and higher than said curved forward portion of the bottom panel, and then converging to the transom outwardly of and higher than said flat stern portion of the bottom panel, and combination cross-bracing and seat means extending between said side panels.

2. A dory according to claim 1 in which said combination means includes two box ribs which extend thwartships in spaced relation to said bottom between the side panels as side braces with one box rib being located about midway of the length of the flat stern portion of the bottom panel and the other box rib being located over the aft part of the curved forward portion of the bottom panel.

3. A dory according to claim 2 in which said bottom and transom have merging cutouts at the center line of the dory providing an open bottom and open rear for a well, side plates for the well extending between the rear box rib and the transom, and a cross-plate between said side plates at a location spaced aft of said rear box rib and defining the front of the well, said cross-plate being adapted to serve as an engine mount.

4. A dory according to claim 3 in which said combination means also includes a flat bow deck connected to the side panels below said gunwales and a skirt depending from the rear of the bow deck and connected to the side panels and bottom panel.

5. A dory according to claim 4 in which an open-ended hawsepipe extends from the bow end of said bottom panel to the intersection of said bow deck and skirt.

6. A dory according to claim 1 in which all of said panels and said transom are aluminum sheet and are welded together, continuous aluminum chines of angle section welded at the inside intersection of said side panels and bottom panels, a continuous aluminum center keelson welded to the bottom panel, a pair of continuous aluminum stringers spaced at opposite sides of the keelson and welded to the bottom panel, and aluminum cross-ribs extending between the keelson and the chines and partially cut out to overlap the stringers, said ribs being welded to the bottom panel, keelson, stringers and chines.

7. A dory according to claim 2 in which said box ribs comprises storage compartments spaced above said bottom panel and have an open top, and seats on the box ribs serving as covers for the open top.

* * * * *